United States Patent [19]

Jokisch et al.

[11] Patent Number: 4,469,559

[45] Date of Patent: Sep. 4, 1984

[54] CONTAINER FOR TRANSPORTING HOT COKE

[75] Inventors: Friedrich Jokisch, Essen; Bernhard Heinrichs, Wattenscheid, both of Fed. Rep. of Germany

[73] Assignee: Krupp-Koppers GmbH, Essen, Fed. Rep. of Germany

[21] Appl. No.: 424,955

[22] Filed: Sep. 27, 1982

[30] Foreign Application Priority Data

Oct. 14, 1981 [DE] Fed. Rep. of Germany ..... 3140736

[51] Int. Cl.[3] ..... C10B 39/02; C10B 39/14

[52] U.S. Cl. ..... 202/270; 202/228; 202/262; 414/287; 414/301; 414/302

[58] Field of Search ..... 202/227, 228, 239, 262, 202/263, 266, 269, 270; 201/39–41; 414/287, 288, 291, 292, 301–303

[56] References Cited

U.S. PATENT DOCUMENTS

| | | | |
|---|---|---|---|
| 4,243,510 | 1/1981 | Dhondt | 414/301 |
| 4,286,912 | 9/1981 | Galow et al. | 414/287 |
| 4,358,345 | 11/1982 | Lorrek | 202/262 |

FOREIGN PATENT DOCUMENTS

| | | | |
|---|---|---|---|
| 0047846 | 3/1982 | European Pat. Off. | 202/227 |
| 0123285 | 7/1982 | Japan | 202/228 |
| 0111379 | 7/1982 | Japan | 202/227 |

*Primary Examiner*—Bradley Garris

*Attorney, Agent, or Firm*—Michael J. Striker

[57] ABSTRACT

A container for transporting hot coke has a cylindrical portion and a narrowing conical portion downwardly extended therefrom. A rotation ring carrying grippers is positioned in the upper region of the container, which is operated during the filling of the container with coke.

8 Claims, 3 Drawing Figures

CONTAINER FOR TRANSPORTING HOT COKEcl

BACKGROUND OF THE INVENTION

The present invention pertains to an apparatus for transporting hot coke discharged from a coke oven battery in general. More particularly, the invention relates to a container for transporting hot coke in a dry cooling process.

Containers for transporting hot coke from a coke oven battery to a cooling shaft (coke cooler) have been utilized in dry cooling apparatus. It is known that during the filling of the coke-transporting container in the dry-cooling in contrast with the wet coke cooling (wet quenching) the quencher cars are not processed and therefore must be at standstill. In this case an optimal smoke ventilation is achieved through an outer cap which is sealingly mounted on the coke-transporting container. This, however causes significant difficulties in uniform distributing of the content of the coke oven chamber in the container, taking into consideration an angle of coke charging. It is also necessary to consider that the construction height of the coke-transporting container is often limited by a given dimension between the track of the quencher car and the oven bottom of the coke oven battery.

It has been already suggested to improve the distribution of hot coke in the container by means of a so-called filler cap guide. This construction is, however rather expensive and its permanent rigidity and functional qualities are questionable when large coke oven chambers are utilized. There has already been proposed (German patent application No. P30 03 374.0) a method in which the coke driven out from the oven chamber is brought into the container such that it moved in rotation during the filling of the container; in this case the entire container area is used for coke cake guiding. This proposal, however, also involved considerable expenses.

SUMMARY OF THE INVENTION

It is an object of the invention to provide an improved coke-transporting container in which a uniform distribution of the coke discharged into the container is ensured.

This and other objects of the invention are attained by a container for transporting hot coke in a dry cooling process in which coke is to be transported from a coke oven to a coke cooler, comprising a substantially cylindrical upper portion having an upper region and a frustoconical lower portion; and a rotatable ring positioned in said upper region, said ring being provided with grippers located in an interior of the container and adapted to seize the coke as it is filled into the container.

The gripper seizing the coke discharged from the oven chamber into the container ensure the fact that coke is uniformly distributed over the whole inner surface of the container. Advantageously, the rotation of the grippers may be proceeded even after the filling operation has been finished; this is advisable to equilize the upper surface of the coke bed.

In accordance with a further feature of the invention the container may include drive means for rotating the ring.

The drive means may be positioned outside the container and connected thereto by any suitable conventional fastening means.

According to still another feature of the invention the container may include means for transmitting the rotation from drive means to said ring. The transmitting means may include a gear, said ring having a toothed flange meshing with said gear, said gear being connected to said drive means.

The ring may be supported in the container by bearings. Furthermore, the container may include an extension element mounted to the cylindrical portion of the container and above said ring, said extension element substantically overlapping and enclosing the drive means and the bearings. Thereby, the bearings and the drive can be sheltered from coke discharged from the oven chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
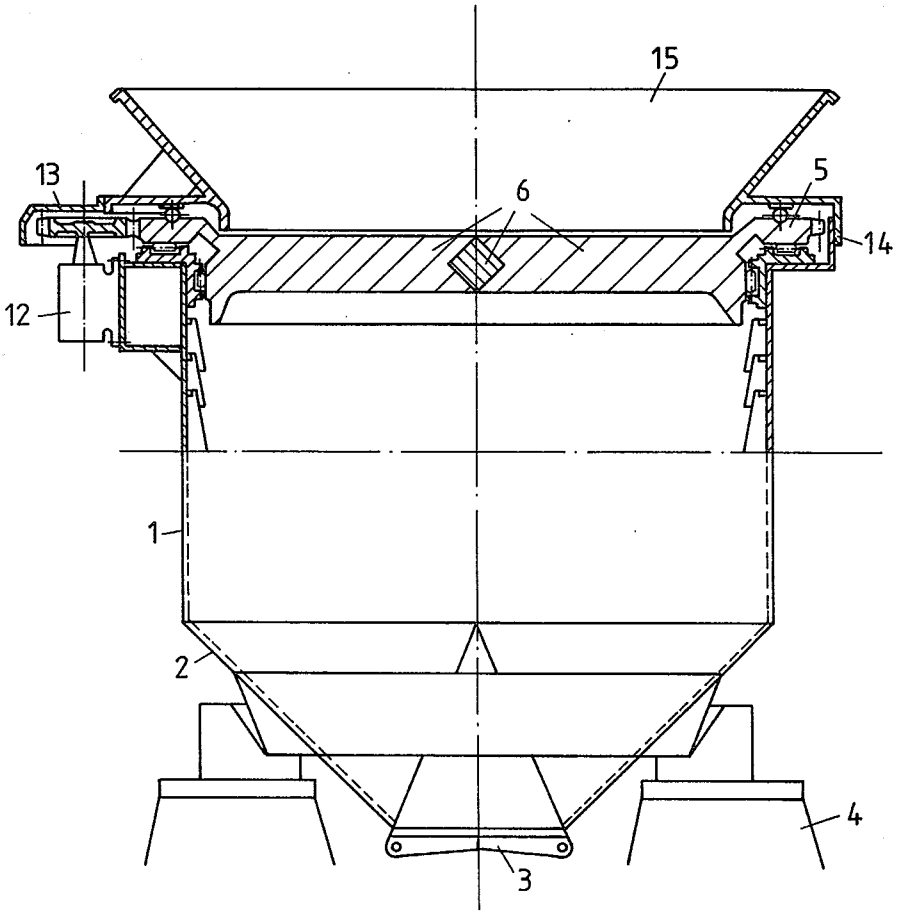
FIG. 1 is a sectional view through a coke-transporting container according to the invention.

Referring now to the drawings, and first to FIG. 1, it will be seen that a coke-transporting container 1 has a substantially cylindrical shape with a narrowing conical lower portion 2 which is provided with a bottom closure 3. Container 1 is supported on an underframe 4 which is processed on a quencher car rail (not shown herein) along a coke oven battery (known in the art and not shown). The coke-transporting container is provided with a device for emptying the container removable from the underframe 4 and not illustrated in the drawings.

Figure 3:
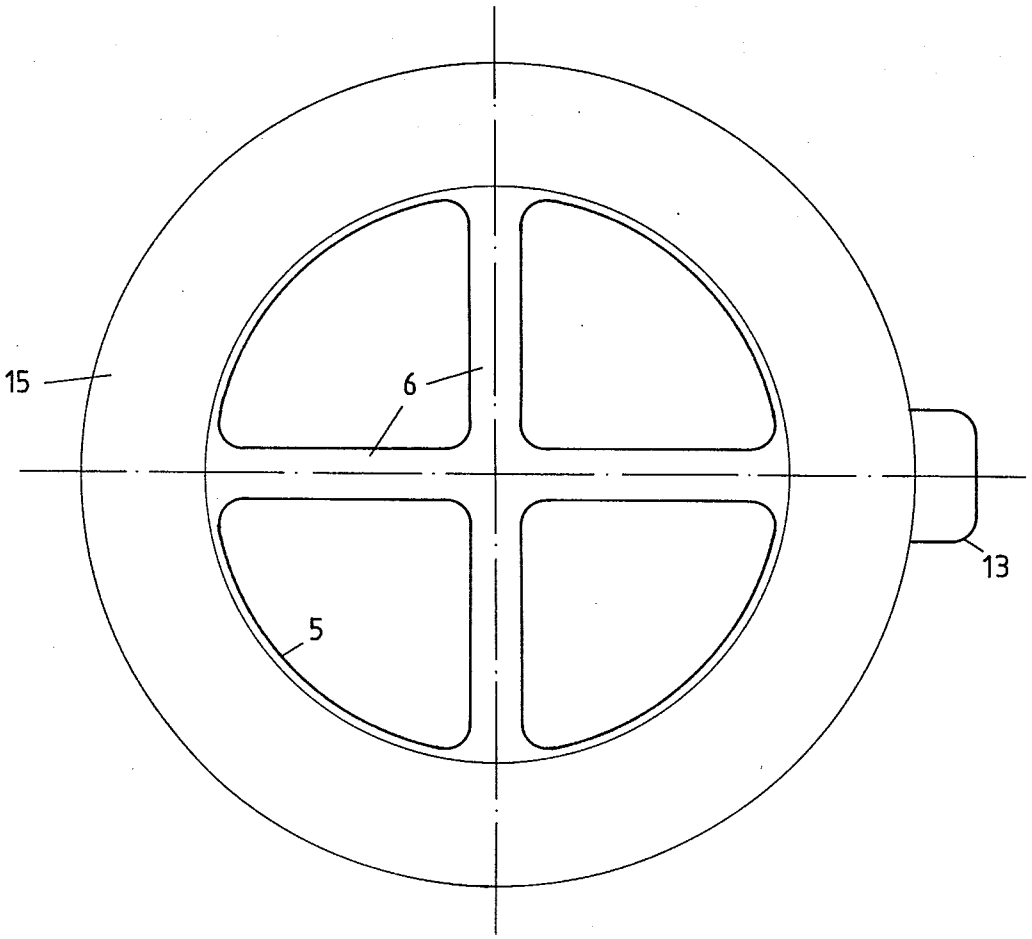
FIG. 3 is a top plan view of the container of FIG. 1.

In accordance with the invention the container is provided a turnable ring 5 positioned in the upper region of the container; ring 5 being formed with grippers 6. As seen in FIG. 3 grippers 6 are positioned in the interior of the container and extend perpendicularly each other. It is, of course understood that any other suitable shape and arrangement of grippers 6 can be suggested in the coke-transporting container of the invention.

Figure 2:
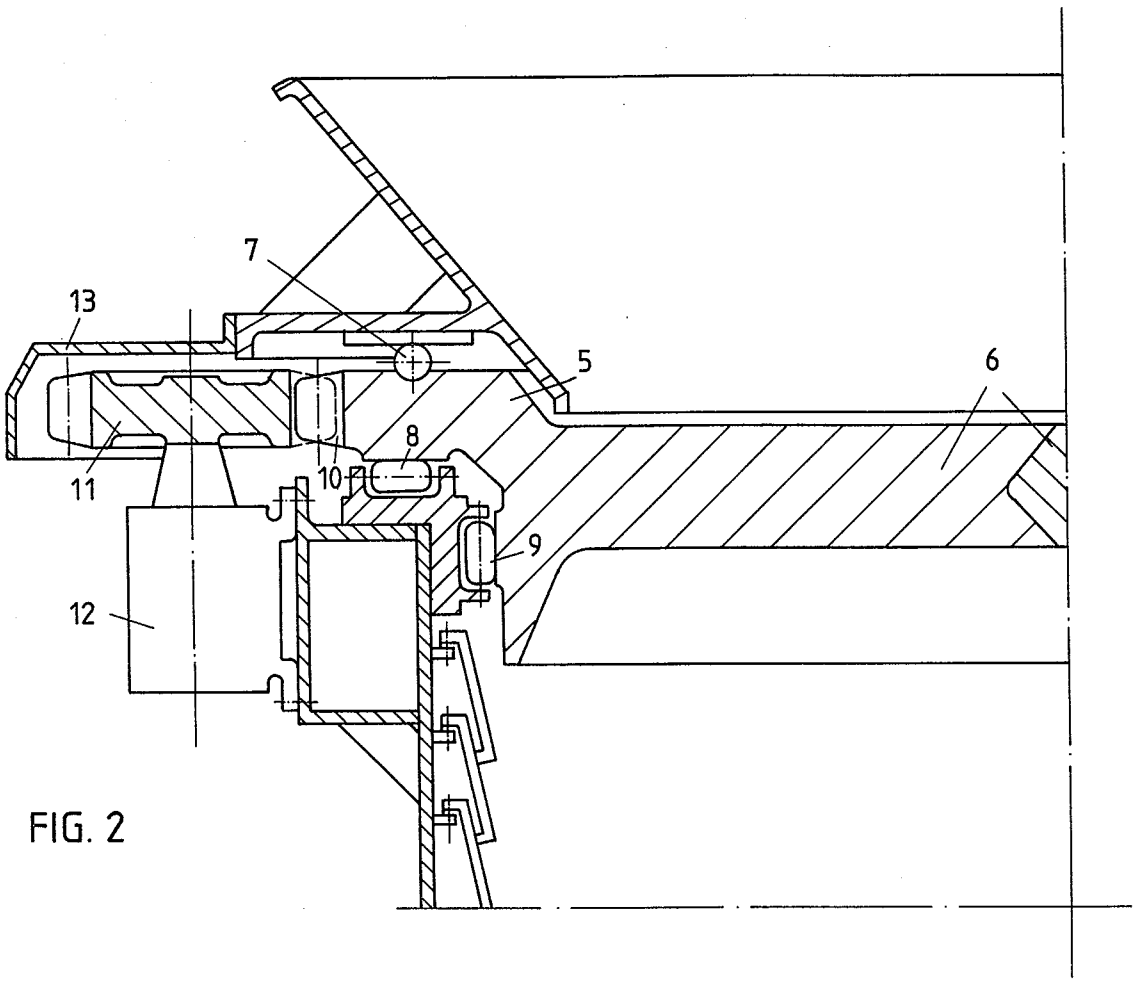
FIG. 2 is a partial sectional view, on enlarged scale, of a rotating ring and its drive.

With reference to FIG. 2 it is seen that the turnable ring 5 which may be integral with grippers 6 is supported and guided at the walls of container 1 by means of ball bearings 7 and roller bearings 8 and 9. Toothed gearing 10 is provided at the periphery of ring 5, which gearing meshes with teeth of a gear 11. The latter is connected to a shaft of a drive 12, for example an electromotor, which is secured to the outer side of container 1. The drive and bearings of the turnable ring 5 are closed at one side with a cover 13 and at the opposite side with a housing portion 14.

Above the ring 5 is arranged a conical extension element or portion 15. Housing portion 14 may be integral with the extension element 15. This element overlaps the turnable ring 5 and protects its drive and bearings against contamination on the one hand, and on the other hand this element serves as a guiding device for coke being filled into the container.

The device according to the invention functions substantially during the filling operation. As coke is filled into the container grippers 6 rotated by ring 5, gear 11 and drive 12 grasp the coke discharged from the oven chamber into the container. The turnable ring and grippers ensure that coke is uniformly distributed over the entire surface of the container. The rotation of the ring 5 is continued for some time even after the ending of the filling process in order to obtain satisfactory equalization of the upper surface of the coke bed.

It will be understood that each of the elements described above, or two or more together, may also find a useful application in other types of containers for transporting hot coke differing from the types described above.

While the invention has been illustrated and described as embodied in a container for transporting hot coke, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A container for transporting hot coke in a dry cooling process in which coke is to be transported from a coke oven to a coke cooler, comprising a substantially cylindrical upper portion having an upper region and a frustoconical lower portion; and a rotatable ring positioned in said upper region above and substantially coincident with said cylindrical portion, said ring being provided with grippers located in an interior of the container and adapted to seize the coke as it is filled into the container.

2. The container as defined in claim 1, further including drive means for rotating said ring.

3. The container as defined in claim 2, wherein said drive means is positioned outside of the container.

4. The container as defined in claim 3, wherein said drive means rotates and further including means for transmitting the rotation from said drive means to said ring.

5. The container as defined in claim 4, wherein said transmitting means include a gear, said ring having a toothed flange meshing with said gear, said gear being connected to said drive means.

6. The container as defined in claim 5, wherein said drive means is connected to said cylindrical upper portion.

7. The container as defined in claim 5, said container having walls, said ring being supported in said walls by bearings.

8. The container as defined in claim 7, further including an extension element mounted to said cylindrical portion above said ring, said extension element substantically overlapping and enclosing said drive means and said bearings.

* * * * *